US010802414B1

(12) United States Patent
Kinuta et al.

(10) Patent No.: US 10,802,414 B1
(45) Date of Patent: Oct. 13, 2020

(54) CHARGING DEVICE, PROCESS CARTRIDGE, IMAGE FORMING APPARATUS, AND ASSEMBLY

(71) Applicant: FUJI XEROX CO., LTD., Tokyo (JP)

(72) Inventors: Yasuhiko Kinuta, Kanagawa (JP); Fuyuki Kano, Kanagawa (JP); Akihiro Nonaka, Kanagawa (JP); Keiko Matsuki, Kanagawa (JP); Kosuke Narita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/746,986

(22) Filed: Jan. 20, 2020

(30) Foreign Application Priority Data

Jul. 18, 2019 (JP) ..... 2019-133036

(51) Int. Cl.
*G03G 15/02* (2006.01)

(52) U.S. Cl.
CPC ..... *G03G 15/0258* (2013.01)

(58) Field of Classification Search
None
See application file for complete search history.

(56) References Cited

U.S. PATENT DOCUMENTS 7,853,172 B2 * 12/2010 Inoue ..... G03G 15/0225 399/100
2005/0191081 A1 * 9/2005 Muraishi ..... G03G 15/0225 399/100

FOREIGN PATENT DOCUMENTS

JP 2015152829 8/2015

* cited by examiner

*Primary Examiner* — Victor Verbitsky
(74) *Attorney, Agent, or Firm* — JCIPRNET

(57) ABSTRACT

A charging device includes a charging roller and a cleaning roller that includes a core and a foamed elastic layer disposed on an outer circumferential surface of the core and that rotates in contact with a surface of the charging roller. The number of ends of a cell skeleton that protrude from a surface of the foamed elastic layer is 25 ends/mm$^2$ or more and 50 ends/mm$^2$ or less. The cleaning roller is disposed in contact with the charging roller such that the compression ratio of the foamed elastic layer is 30% or less. The compression ratio is represented by Equation (1):

$$\text{compression ratio (\%)}=(r1/2+r2/2-d)/t1\times100 \qquad \text{Equation (1):}$$

where r1 is the outer diameter (mm) of the cleaning roller, r2 is the outer diameter (mm) of the charging roller, d is the interaxial distance (mm) between the charging roller and the cleaning roller, and t1 is the thickness (mm) of the foamed elastic layer of the cleaning roller.

20 Claims, 5 Drawing Sheets

CHARGING DEVICE, PROCESS CARTRIDGE, IMAGE FORMING APPARATUS, AND ASSEMBLY

CROSS-REFERENCE TO RELATED APPLICATIONS

This application is based on and claims priority under 35 USC 119 from Japanese Patent Application No. 2019-133036 filed Jul. 18, 2019.

BACKGROUND

(i) Technical Field

The present disclosure relates to charging devices, process cartridges, image forming apparatuses, and assemblies.

(ii) Related Art

Japanese Unexamined Patent Application Publication No. 2015-152829 discloses a charging device including a roller-shaped charging member and a roller-shaped cleaning member. The charging member includes a conductive support, a conductive elastic layer disposed on the outer circumferential surface of the conductive support, and a conductive surface layer disposed on the outer circumferential surface of the conductive elastic layer. The conductive surface layer has a surface free energy of 50 mN/m or more and 90 mN/m or less. The cleaning member includes a support and a foamed elastic layer disposed on the outer circumferential surface of the support. The foamed elastic layer contains 40 or more and 75 or less foam cells per 25 mm. The cleaning member rotates in contact with the conductive surface layer of the charging member.

SUMMARY

Aspects of non-limiting embodiments of the present disclosure relate to a charging device having a reduced tendency to cause longitudinal and lateral streak-like image defects as compared to a charging device including a charging roller and a cleaning roller in which the number of ends of the cell skeleton that protrude from the surface of a foamed elastic layer is less than 25 ends/mm$^2$ or more than 50 ends/mm$^2$ and which is disposed in contact with the charging roller such that the compression ratio of the foamed elastic layer as represented by Equation (1) is 30% or less, or a cleaning roller in which the number of ends of the cell skeleton that protrude from the surface of a foamed elastic layer is 25 ends/mm$^2$ or more and 50 ends/mm$^2$ or less and which is disposed in contact with the charging roller such that the compression ratio of the foamed elastic layer as represented by Equation (1) is more than 30%.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a charging device comprising a charging roller and a cleaning roller that includes a core and a foamed elastic layer disposed on an outer circumferential surface of the core and that rotates in contact with a surface of the charging roller. The number of ends of a cell skeleton that protrude from a surface of the foamed elastic layer is 25 ends/mm$^2$ or more and 50 ends/mm$^2$ or less. The cleaning roller is disposed in contact with the charging roller such that the compression ratio of the foamed elastic layer is 30% or less. The compression ratio is represented by Equation (1):

$$\text{compression ratio (\%)}=(r1/2+r2/2-d)/t1\times 100 \qquad \text{Equation (1):}$$

where r1 is the outer diameter (mm) of the cleaning roller, r2 is the outer diameter (mm) of the charging roller, d is the interaxial distance (mm) between the charging roller and the cleaning roller, and t1 is the thickness (mm) of the foamed elastic layer of the cleaning roller.

BRIEF DESCRIPTION OF THE DRAWINGS

An exemplary embodiment of the present disclosure will be described in detail based on the following figures, wherein.

DETAILED DESCRIPTION

Figure 1:
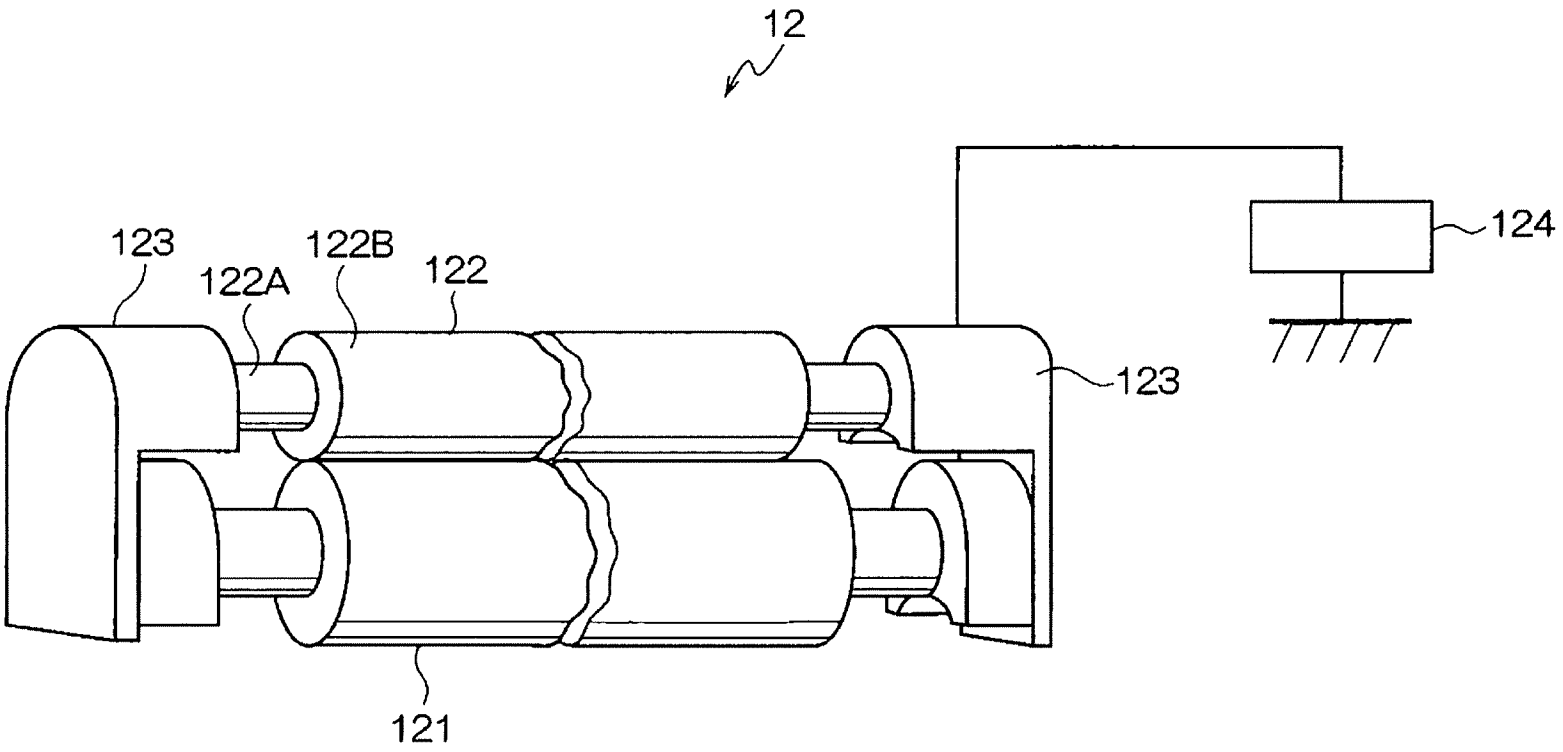
FIG. 1 is a schematic perspective view of a charging device according to the exemplary embodiment.

An exemplary embodiment of the present disclosure will hereinafter be described.

A charging device according to the exemplary embodiment comprises a charging roller and a cleaning roller that rotates in contact with the surface of the charging roller.

The cleaning roller includes a core and a foamed elastic layer disposed on the outer circumferential surface of the core. The number of ends of the cell skeleton that protrude from the surface of the foamed elastic layer of the cleaning roller is 25 ends/mm$^2$ or more and 50 ends/mm$^2$ or less. The cleaning roller is disposed in contact with the charging roller such that the compression ratio of the foamed elastic layer as represented by Equation (1) is 30% or less.

The cleaning roller cleans the surface of the charging roller, for example, by rotating as the charging roller rotates.

The foregoing configuration of the charging device according to the exemplary embodiment may improve the cleaning performance of the cleaning roller and may reduce its tendency to cause streak-like image defects. One possible explanation is given below.

In the related art, streak-like image defects may occur in the transport direction of a recording medium (i.e., in the rotational direction of an image carrier) when the surface of a charging roller is contaminated with substances such as discharge products and toner. Accordingly, the surface of the charging roller is cleaned with a cleaning roller to reduce longitudinal streak-like image defects due to the contamination of the surface of the charging roller.

However, it is desirable to further reduce the contamination of the surface of the charging roller to achieve a longer life.

The cleaning performance of the cleaning roller may be improved if the number of ends of the cell skeleton that protrude from the surface of the foamed elastic layer of the cleaning roller is 25 ends/mm$^2$ or more and 50 ends/mm$^2$ or less. This is probably because an increased number of ends of the cell skeleton may result in a better chance of the ends contacting the surface of the charging roller (i.e., a better chance of the ends cleaning the surface of the charging roller).

On the other hand, if a cleaning roller having an increased number of ends of the cell skeleton is disposed in contact with the charging roller such that the foamed elastic layer is excessively compressed in order to improve the cleaning performance, lateral streak-like image defects may occur in a direction crossing the transport direction of a recording medium (i.e., in the axial direction of an image carrier). This is probably because the compression of the foamed elastic layer of the cleaning roller over a long period of time induces compression set in the foamed elastic layer.

Accordingly, if the cleaning roller is disposed in contact with the charging roller such that the compression ratio of the foamed elastic layer as represented by Equation (1) is 30% or less (i.e., such that the compression ratio of the foamed elastic layer is reduced as compared to the related art), less compression set may be induced in the foamed elastic layer, and lateral streak-like image defects may be reduced.

As described above, the foregoing configuration of the charging device according to the exemplary embodiment may improve the cleaning performance of the cleaning roller and may reduce its tendency to cause streak-like image defects.

The charging device according to the exemplary embodiment will hereinafter be described with reference to the drawings. It should be noted that components having substantially the same functions are indicated by the same reference numerals throughout the drawings, and a description thereof may be omitted.

As shown in FIG. 1, a charging device 12 according to the exemplary embodiment includes, for example, a charging roller 121 and a cleaning roller 122 that are disposed in contact with each other at a specific depth of depression. A conductive core (30 in FIGS. 2 and 3) of the charging roller 121 and a core 122A of the cleaning roller 122 are supported at both ends in the axial direction by conductive bearings 123 (e.g., conductive rolling bearings) so that each member is rotatable. A power supply 124 is connected to one of the conductive bearings 123.

The individual components of the charging device 12 will hereinafter be described in detail.

Charging Roller

The charging roller 121 will hereinafter be described with reference to FIGS. 2 and 3.

Figure 2:
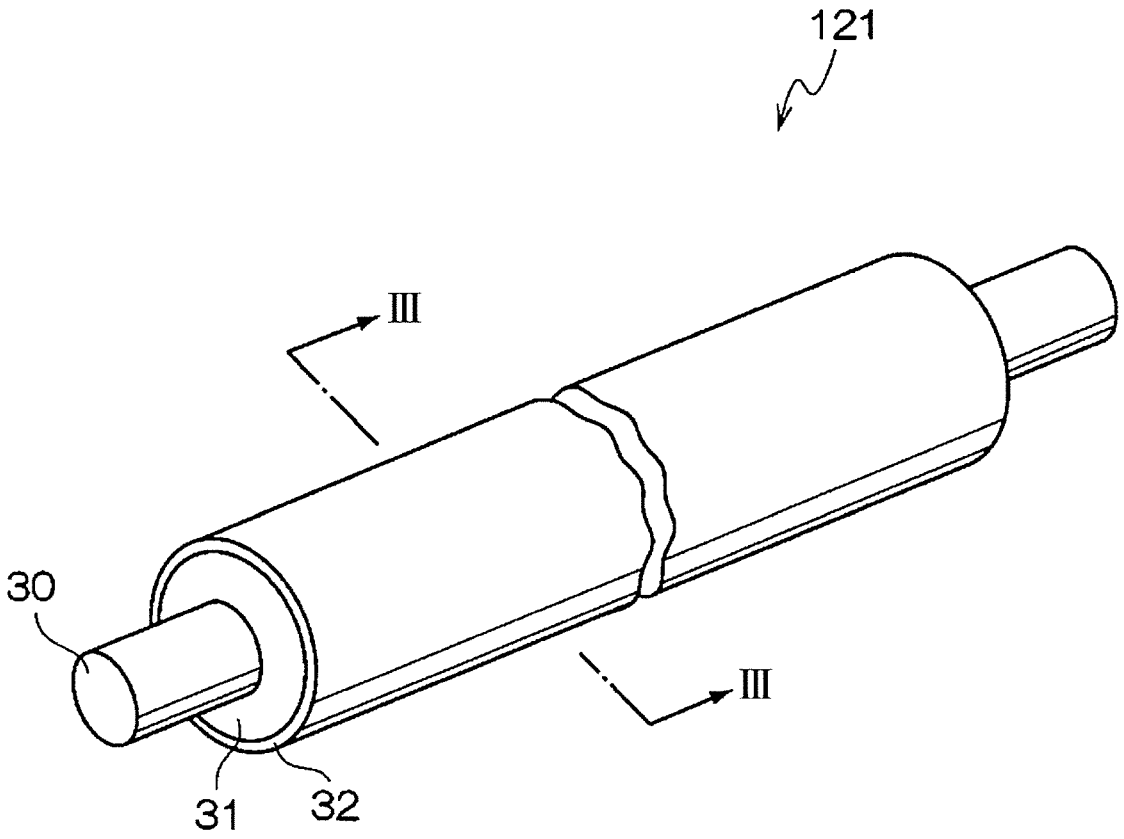
FIG. 2 is a schematic perspective view of a charging roller according to the exemplary embodiment.

FIG. 2 is a schematic perspective view of the charging roller according to the exemplary embodiment. FIG. 3 is a schematic sectional view of the charging roller according to the exemplary embodiment. FIG. 3 is a sectional view taken along line III-III of FIG. 2.

Figure 3:
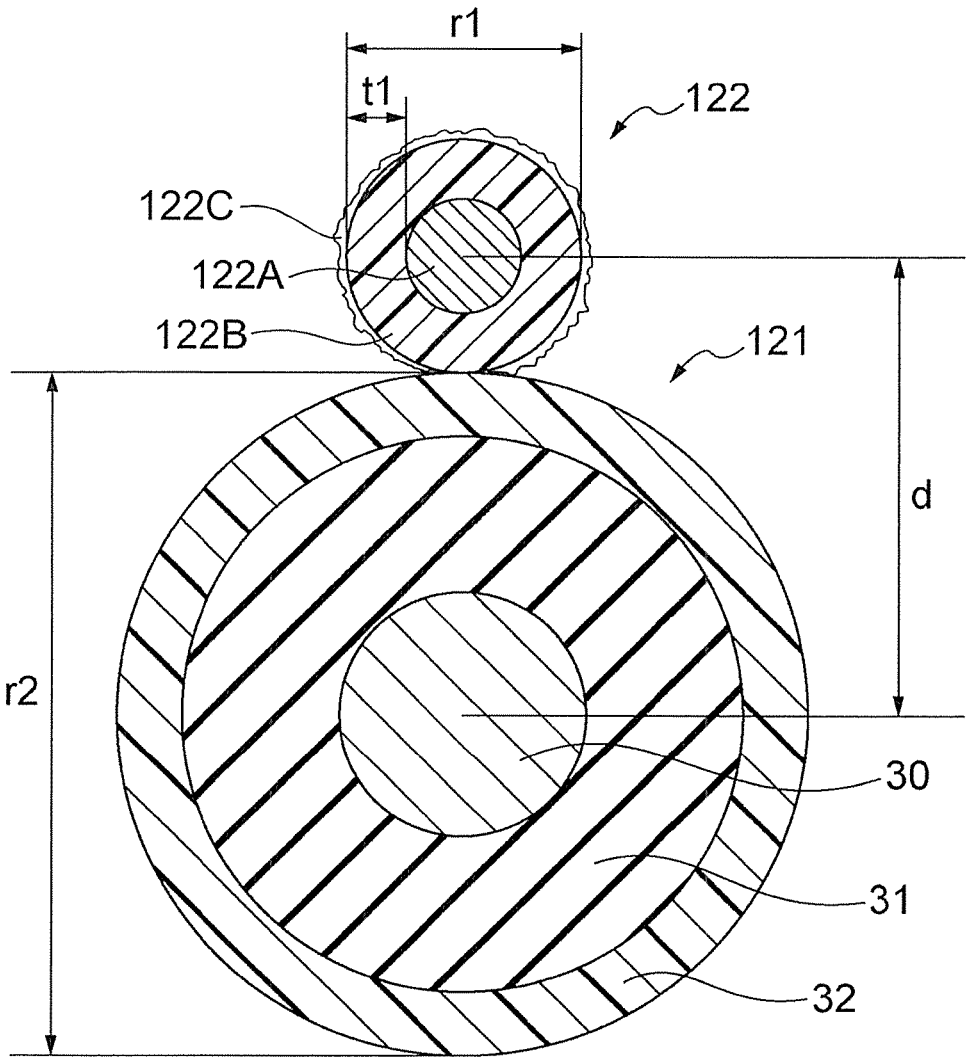
FIG. 3 is a schematic sectional view of the charging roller according to the exemplary embodiment (corresponding a sectional view taken along line III-III of FIG. 2)

As shown in FIGS. 2 and 3, the charging roller 121 is, for example, a roller member including a conductive core 30 (hereinafter referred to as "core 30"), a conductive elastic layer 31 (hereinafter referred to as "elastic layer 31") disposed on the outer circumferential surface of the conductive core 30, and a conductive surface layer 32 (hereinafter referred to as "surface layer 32") disposed on the outer circumferential surface of the conductive elastic layer 31. For example, an adhesive layer (not shown) is disposed between the core 30 and the elastic layer 31.

The charging roller 121 is not limited to the foregoing layer configuration, but may instead have, for example, a configuration in which an intermediate layer is disposed between the core 30 and the elastic layer 31 or a configuration in which a resistance adjustment layer or a transfer blocking layer is disposed between the elastic layer 31 and the surface layer 32.

The charging roller 121 is not limited to a roller member, but may instead be, for example, a belt member.

As used herein, the term "conductive" refers to a volume resistivity of less than $1\times10^{13}$ Ωcm at 20° C.

The charging roller 121 will hereinafter be described in detail. It should be noted that reference numerals are omitted in the description below.

Core

The core functions as an electrode and support member for the charging roller. Examples of materials that may be used for the core include metals and alloys such as iron (e.g., free-cutting steel), copper, brass, stainless steel, aluminum, and nickel; and iron coated with metals such as chromium and nickel. Other examples of cores include members (e.g., resin and ceramic members) having the outer circumferential surfaces thereof coated with metals and members (e.g., resin and ceramic members) having conductors dispersed therein. The core may be a hollow member (i.e., a tubular member) or a non-hollow member.

Adhesive Layer

Examples of materials that may be used for the adhesive layer include known adhesives that are conductive compositions capable of bonding the core and the elastic layer together. Examples of such adhesives include resin compositions containing electronic conductors and resin compositions containing conductive resins.

Elastic Layer

The elastic layer contains an elastic material and a conductor. The elastic layer may optionally contain other additives. The elastic layer may function as a resistance adjustment layer.

Examples of elastic materials include isoprene rubber, chloroprene rubber, epichlorohydrin rubber, butyl rubber, urethane rubber, silicone rubber, fluorocarbon rubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene copolymer rubber, acrylonitrile-butadiene copolymer rubber, natural rubber, and mixtures thereof.

Preferred of these elastic materials are silicone rubber, ethylene-propylene rubber, epichlorohydrin-ethylene oxide copolymer rubber, epichlorohydrin-ethylene oxide-allyl glycidyl ether copolymer rubber, and mixtures thereof.

The rubber material may be foamed or unfoamed.

Examples of conductors include electronically conductive materials and ionically conductive materials.

Examples of electronically conductive materials include carbon black such as Ketjen black and acetylene black; pyrolytic carbon; graphite; metals such as zinc, aluminum, copper, iron, nickel, chromium, and titanium; and known metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO.

Examples of ionically conductive materials include known salts such as quaternary ammonium salts, alkali metal perchlorates, and alkaline earth metal perchlorates.

These conductors may be used alone or in a combination of two or more thereof.

The conductor may be present in any amount as long as the intended properties of the elastic layer are achieved.

Specifically, if the conductor is an electronically conductive material, it may be present in an amount of 1 part by mass or more and 90 parts by mass or less per 100 parts by mass of the elastic material.

On the other hand, if the conductor is an ionically conductive material, it may be present in an amount of 0.01 parts by mass or more and 10 parts by mass or less per 100 parts by mass of the elastic material.

Examples of other additives that may be used for the elastic layer include known additives such as softeners, plasticizers, vulcanizing agents, vulcanization accelerators, antioxidants, surfactants, and coupling agents.

If the elastic layer functions as, for example, a resistance adjustment layer, it may have a volume resistivity of, for example, $10^3$ Ωcm or more and $10^{14}$ Ωcm or less, preferably $10^5$ Ωcm or more and $10^{12}$ Ωcm or less, more preferably $10^7$ Ωcm or more and $10^{12}$ Ωcm or less.

The volume resistivity of the elastic layer is measured by the method presented below.

Specifically, a sheet-shaped test specimen is removed from the elastic layer. A voltage is applied to the test specimen for 30 seconds in accordance with JIS K 6911 (1995) using a test jig (R12702A/B resistivity chamber available from Advantest Corporation) and a high-resistance meter (R8340A digital high-resistance/extremely-low-current meter available from Advantest Corporation). The applied voltage is adjusted so that the electric field (applied voltage/composition sheet thickness) is 1,000 V/cm. The volume resistivity is calculated from the current flowing through the test specimen using the following equation:

Volume resistivity (Ωcm)=(19.63×applied voltage (V))/(current (A)×test specimen thickness (cm))

The thickness of the elastic layer varies depending on the apparatus to which the charging roller is applied. For example, the elastic layer may have a thickness of 1 mm or more and 10 mm or less, preferably 2 mm or more and 5 mm or less.

The thickness of the elastic layer is measured by the method presented below.

Specifically, specimens are cut using a single-edged knife from the elastic layer at three positions, namely, at positions 20 mm from both ends and in the center of the elastic layer (charging roller) in the axial direction. The thicknesses of the cut specimens are measured by observing the cross-sections thereof at a suitable magnification in the range from 5× to 50×, depending on the thickness, and the average thereof is calculated. A VHX-200 digital microscope available from Keyence Corporation is used for the measurement.

Surface Layer

The surface layer may be a resin layer independently provided on the elastic layer or may be formed by impregnating bubbles in a surface portion of a foamed elastic layer with a resin or other material (that is, the surface layer may be a surface portion of the elastic layer in which bubbles are impregnated with a resin or other material).

Examples of materials that may be used to form the surface layer include resins.

Examples of resins include acrylic resins, fluorine-modified acrylic resins, silicone-modified acrylic resins, cellulose resins, polyamide resins, nylon copolymers, polyurethane resins, polycarbonate resins, polyester resins, polyimide resins, epoxy resins, silicone resins, polyvinyl alcohol resins, polyvinyl butyral resins, polyvinyl acetal resins, ethylene-tetrafluoroethylene resins, melamine resins, polyethylene resins, polyvinyl resins, polyarylate resins, polythiophene resins, polyethylene terephthalate resins (PET), and fluorocarbon resins (e.g., polyvinylidene fluoride resins, tetrafluoroethylene resins, tetrafluoroethylene-perfluoro(alkyl vinyl ether) copolymers (PFA), and tetrafluoroethylene-hexafluoropropylene copolymers (FEP)). Curable resins may be cured or crosslinked with curing agents or catalysts.

Nylon copolymers are copolymers containing one or more polymerized units selected from the group consisting of nylon 6,10, nylon 11, and nylon 12. Nylon copolymers may also contain other polymerized units such as nylon 6 and nylon 66.

Of these, polyvinylidene fluoride resins, tetrafluoroethylene resins, and polyamide resins are preferred as resins to inhibit soiling, and polyamide resins are more preferred to improve the wear resistance of the surface layer and to reduce the susceptibility of porous resin particles to come off.

In particular, alkoxymethylated polyamides (e.g., alkoxymethylated nylons) are preferred as polyamide resins to improve the wear resistance of the surface layer, and methoxymethylated polyamides (e.g., N-methoxymethylated nylons) are more preferred.

To improve the mechanical strength of the surface layer and to reduce the susceptibility of the surface layer to cracking, the resin may have a crosslinked structure.

If the resin has a crosslinked structure, the surface layer preferably has a gel fraction of 50% or more and 100% or less, more preferably 60% or more and 100% or less.

The gel fraction is measured in accordance with JIS K6796(1998).

Specifically, a test specimen is removed from the surface layer. The mass of the removed test specimen is measured and used as the mass before solvent extraction. The test specimen is then immersed in the solvent used for the preparation of the coating solution for forming the surface layer for 24 hours. The solvent is removed by filtration, and the residue is weighed. This weight is used as the mass after extraction. The gel fraction is calculated using the following equation:

gel fraction=100×(mass after solvent extraction)/(mass before solvent extraction) Equation:

Examples of other materials that may be used to form the surface layer include known additives that can typically be added to surface layers, such as conductors, fillers, curing agents, vulcanizing agents, vulcanization accelerators, antioxidants, surfactants, and coupling agents.

The surface layer may have a volume resistivity of, for example, $10^3$ Ωcm or more and $10^{14}$ Ωcm or less, preferably $10^5$ Ωcm or more and $10^{12}$ Ωcm or less, more preferably $10^7$ Ωcm or more and $10^{12}$ Ωcm or less.

The volume resistivity of the surface layer is measured by the method presented below.

Specifically, the surface layer is applied to a plate of a metal such as aluminum or stainless steel or to a sheet of a rubber or other material with a volume resistivity of 10 Ωcm or less to obtain a test specimen. A voltage is then applied to the test specimen for 30 seconds in accordance with JIS K 6911(1995) using a test jig (R12702A/B resistivity chamber available from Advantest Corporation) and a high-resistance meter (R8340A digital high-resistance/extremely-low-current meter available from Advantest Corporation). The applied voltage is adjusted so that the electric field (applied voltage/composition sheet thickness) is 1,000 V/cm. The volume resistivity is calculated from the current flowing through the test specimen using the following equation:

Volume resistivity (Ωcm)=(19.63×applied voltage (V))/(current (A)×test specimen thickness (cm))

To reduce contamination and cracking, the surface layer may have a dynamic ultra micro hardness of, for example, 0.04 or more and 0.5 or less, preferably 0.08 or more and 0.3 or less.

The dynamic ultra micro hardness (hereinafter also referred to as "DH") of the surface layer is the hardness calculated using the following equation:

$$DH=\alpha\times P/D^2 \quad \text{Equation:}$$

where α is a constant depending on the shape of the indenter, P (mN) is the test load at which the indenter is pressed into the specimen at a constant indentation rate (mN/s), and D (μm) is the depth of indentation.

The dynamic ultra micro hardness is measured using a DUH-W201S dynamic ultra micro hardness tester (available from Shimadzu Corporation). The dynamic ultra micro hardness can be determined from the depth of indentation D measured by a soft material measurement in which a triangular pyramidal indenter (apex angle=115°, α=3.8584) is pressed into the surface layer of the charging roller at an indentation rate of 0.14 mN/s and a test load of 1.0 mN.

To reduce the movement of components bleeding from the elastic layer (i.e., liquid bleeding therefrom) and components blooming from the elastic layer (i.e., solid precipitating therefrom) to the surface of the charging roller and to improve the resistance stability of the surface layer, the surface layer may have a thickness of, for example, 2 μm or more and 25 μm or less, preferably 3 μm or more and 20 μm or less, more preferably 3 μm or more and 15 μm or less, even more preferably 5 μm or more and 15 μm or less.

The thickness of the surface layer is measured by the method presented below.

Specifically, specimens are cut using a single-edged knife from the surface layer at three positions, namely, at positions 20 mm from both ends and in the center of the surface layer (charging roller) in the axial direction. The thicknesses of the cut specimens are measured by observing the cross-sections thereof at a magnification of 1000×, and the average thereof is calculated. A VHX-200 digital microscope available from Keyence Corporation is used for the measurement.

The surface layer is formed, for example, by dispersing various ingredients in a solvent to prepare a coating solution, applying the coating solution to an elastic layer formed in advance, and heating the coating.

Examples of processes that may be used to apply the coating solution include blade coating processes, wire bar coating processes, spray coating processes, dip coating processes, bead coating processes, air knife coating processes, curtain coating processes, flow coating processes, ring coating processes, die coating processes, and inkjet coating processes.

The solvent used for the coating solution may be any commonly used solvent. Examples of solvents that may be used include alcohols such as methanol, ethanol, propanol, and butanol; ketones such as acetone and methyl ethyl ketone; and ethers such as tetrahydrofuran, diethyl ether, and dioxane. Although various other solvents may also be used, alcohol solvents, ketone solvents, and mixtures thereof may be used for dip coating processes.

Cleaning Roller

As shown in FIGS. 1 and 3, the cleaning roller 122 is, for example, a roller member including a core 122A and a foamed elastic layer 122B disposed on the outer circumferential surface of the core 122A.

The cleaning roller 122 according to the exemplary embodiment will hereinafter be described in detail. It should be noted that reference numerals are omitted in the description below.

Core

The core is a solid or hollow cylindrical conductive member. Examples of materials that may be used for the core include metals such as iron (e.g., free-cutting steel), copper, brass, stainless steel, aluminum, and nickel.

Other examples of cores include members (e.g., resin and ceramic members) having the outer circumferential surfaces thereof coated with metals and members (e.g., resin and ceramic members) having conductors dispersed therein.

Foamed Elastic Layer

The foamed elastic layer is, for example, an elastic layer formed of a foam having a three-dimensional porous structure with inner cavities and surface irregularities.

The foamed elastic layer is formed from a foamable resin or rubber material such as polyurethane, polyethylene, polyamide, polyolefin, melamine resin, polypropylene, acrylonitrile-butadiene copolymer rubber (NBR), ethylene-propylene-diene copolymer rubber (EPDM), natural rubber, styrene-butadiene rubber, chloroprene rubber, silicone rubber, or nitrile rubber.

Of these foamable resin and rubber materials, polyurethane is particularly suitable for efficiently removing foreign matter such as toner and external additive by sliding contact with the charging roller, thereby reducing streak-like image defects, while leaving less scratches on the surface of the charging roller due to rubbing with the cleaning roller, and for improving the resistance to tear and other damage over a long period of time.

Examples of polyurethanes include, but not limited to, reaction products of polyols (e.g., polyester polyols, polyether polyols, and acrylic polyols) with isocyanates (e.g., 2,4-tolylene diisocyanate, 2,6-tolylene diisocyanate, 4,4-diphenylmethane diisocyanate, tolidine diisocyanate, and 1,6-hexamethylene diisocyanate) and those reacted with chain extenders (e.g., 1,4-butanediol and trimethylolpropane).

In addition to the foamable resin or rubber material, additives such as blowing agents and foam stabilizers may optionally be used to form the foamed elastic layer. In particular, polyurethanes are typically foamed using additives such as blowing agents and foam stabilizers.

Examples of blowing agents that may be used include known blowing agents such as water and azo compounds (e.g., azodicarbonamide and azobisisobutyronitrile).

Examples of foam stabilizers that may be used include known foam stabilizers such as silicone foam stabilizers (e.g., straight silicones such as dimethyl silicone oil, methyl hydrogen silicone oil, diphenyl silicone oil, methyl phenyl silicone oil, and chlorophenyl silicone oil; and modified silicone oils such as alkyl-modified silicone oils, aralkyl-modified silicone oils, polyether-modified silicone oils, polyester-modified silicone oils, fluoroalkyl-modified silicone oils, amino-modified silicone oils, alkoxy-modified silicone oils, epoxy-modified silicone oils, and carboxyl-modified silicone oils).

The foamed elastic layer may be a tubular foamed elastic member formed around the entire outer circumferential surface of the core or may be a strip-shaped foamed elastic member wound spirally around the outer circumferential surface of the core.

Number of Ends of Cell Skeleton

The number of ends of the cell skeleton (122C in FIG. 3) that protrude from the surface of the foamed elastic layer of the cleaning roller is 25 ends/mm$^2$ or more and 50 ends/mm$^2$ or less. To reduce longitudinal streak-like image defects, it is preferred that the number of ends of the cell skeleton be 30 ends/mm$^2$ or more and 45 ends/mm$^2$ or less, more preferably 30 ends/mm$^2$ or more and 40 ends/mm$^2$ or less.

As used herein, the term "cell skeleton" refers to a linear or film-like structure forming cells (i.e., bubbles). The term "ends of the cell skeleton that protrude from the surface of the foamed elastic layer" refers to portions of the structure that protrude from the surface of the foamed elastic layer.

The number of ends of the cell skeleton that protrude from the surface of the foamed elastic layer is measured as follows.

Measurement Conditions

Measurement instrument: laser microscope (VK-X150, available from Keyence Corporation)

Objective lens magnification: 10×

Measurement size: 2,048×1,536 pixels (0.68 μm/pixel)

Measurement pitch: 3 μm

The surface of the foamed elastic layer is observed under the foregoing conditions. The number of protruding ends of the cell skeleton is counted and converted into the number of ends per square millimeter. The surface of the foamed elastic layer is observed at three positions for each cleaning roller, and the average number of ends of the cell skeleton at the three positions is calculated.

The number of ends of the cell skeleton that protrude from the surface of the foamed elastic layer can be controlled, for example, by adjusting the average number of cells and the density.

Specifically, the average number of cells in the foamed elastic layer is preferably at least 80 cells/25 mm, more preferably at least 85 cells/25 mm, even more preferably at least 90 cells/25 mm. On the other hand, the average number of cells in the foamed elastic layer may be not more than 120 cells/25 mm from the viewpoint of a decrease in the strength of the foamed elastic layer.

The density of the foamed elastic layer is preferably 75 kg/m$^3$ or more and 90 kg/m$^3$ or less, more preferably 80 kg/m$^3$ or more and 90 kg/m$^3$ or less, even more preferably 80 kg/m$^3$ or more and 85 kg/m$^3$ or less.

The average number of cells is the number of cells described in JIS K 6400-1(2004) and is measured by the method described in Appendix 1 of JIS K 6400-1(2004).

The density is measured by the method described in JIS K 7222(2005).

Compression Ratio of Foamed Elastic Layer

The number of ends of the cell skeleton that protrude from the surface of the foamed elastic layer of the cleaning roller is 25 ends/mm$^2$ or more and 50 ends/mm$^2$ or less, and the cleaning roller is disposed in contact with the charging roller such that the compression ratio of the foamed elastic layer as represented by Equation (1) is 30% or less. This may reduce lateral streak-like image defects even if the number of ends of the cell skeleton that protrude from the surface of the foamed elastic layer falls within the above range.

The compression ratio is preferably 10% or more and 30% or less, more preferably 15% or more and 30% or less. The cleaning roller exhibits cleaning capability as long as the cleaning roller is in contact with the surface of the charging roller. That is, the lower limit of the compression ratio may be 0%.

$$\text{compression ratio (\%)}=(r1/2+r2/2-d)/t1\times 100 \qquad \text{Equation (1):}$$

where r1 is the outer diameter (mm) of the cleaning roller, r2 is the outer diameter (mm) of the charging roller, d is the interaxial distance (mm) between the charging roller and the cleaning roller, and t1 is the thickness (mm) of the foamed elastic layer of the cleaning roller (see FIG. 3).

Area Fraction of Cell Skeleton

To reduce longitudinal and lateral streak-like image defects, it is preferred that the area fraction of the cell skeleton at a depth of 200 μm from the surface of the foamed elastic layer of the cleaning roller be 45% or more, more preferably 50% or more, even more preferably 55% or more.

The area fraction of the cell skeleton can be controlled, for example, by adjusting the average number of cells and the density. To control the area fraction of the cell skeleton within the above range, the average number of cells and the density may be adjusted within the above ranges.

The area fraction of the cell skeleton is measured as follows.

The area fraction of the cell skeleton is measured at each depth in the depth direction (i.e., in the thickness direction) from the surface of the foamed elastic layer of interest under the following conditions. The measurement data is output in csv file format. Using the outermost surface height among all measured values as a reference, the area fraction of the cell skeleton at a depth of 200 μm from the reference is calculated.

Measurement Conditions

Measurement instrument: laser microscope (VK-X150, available from Keyence Corporation)

Objective lens magnification: 10×

Measurement size: 2,048×1,536 pixels (0.68 μm/pixel)

Measurement pitch: 3 μm

Conductive Bearings and Power Supply

The conductive bearings 123 and the power supply 124 of the charging device 12 will now be described.

The conductive bearings 123 are members that hold together the charging roller 121 and the cleaning roller 122 so that they are rotatable while maintaining the interaxial distance therebetween.

This interaxial distance is adjusted to control the depth of depression of the cleaning roller 122 against the charging roller 121.

The conductive bearings 123 may be formed from any material and may take any form as long as they are manufactured from a conductive material. For example, conductive rolling bearings and conductive plain bearings may be used.

The power supply 124 is a device that applies a voltage to the conductive bearings 123 to charge the charging roller 121 and the cleaning roller 122 to the same polarity. Known high-voltage power supply devices may be used.

Assembly

An assembly according to the exemplary embodiment comprises a roller to be cleaned and a cleaning roller that includes a core and a foamed elastic layer disposed on the outer circumferential surface of the core and that rotates in contact with the surface of the roller to be cleaned. The number of ends of the cell skeleton that protrude from the surface of the foamed elastic layer is 25 ends/mm$^2$ or more and 50 ends/mm$^2$ or less. The cleaning roller is disposed in contact with the roller to be cleaned such that the compression ratio of the foamed elastic layer is 30% or less. The compression ratio is represented by Equation (2):

$$\text{compression ratio (\%)}=(r1/2+r2/2-d)/t1\times 100 \qquad \text{Equation (2):}$$

where r1 is the outer diameter (mm) of the cleaning roller, r2 is the outer diameter (mm) of the roller to be cleaned, d is the interaxial distance (mm) between the roller to be cleaned and the cleaning roller, and t1 is the thickness (mm) of the foamed elastic layer of the cleaning roller.

The assembly according to the exemplary embodiment has the same configuration as the charging device according to the exemplary embodiment described above except that the assembly includes, as the roller to be cleaned, a roller such as a charging roller, a transfer roller (e.g., a first transfer roller, a second transfer roller, or an intermediate transfer roller), or a transport roller.

The cleaning roller of the assembly according to the exemplary embodiment may have improved cleaning performance, and the likelihood of poor cleaning of the roller to be cleaned due to compression set in the cleaning roller may be reduced.

Image Forming Apparatus and Process Cartridge

An image forming apparatus according to the exemplary embodiment comprises an image carrier, a charging device that charges the image carrier, a latent image forming device that forms a latent image on a charged surface of the image carrier, a developing device that develops the latent image formed on the surface of the image carrier with a toner to form a toner image, and a transfer device that transfers the toner image formed on the surface of the image carrier to a recording medium. The charging device is the charging device according to the exemplary embodiment described above.

A process cartridge according to the exemplary embodiment is attachable to and detachable from, for example, an image forming apparatus having the foregoing configuration. The process cartridge according to the exemplary embodiment comprises an image carrier and a charging device that charges the image carrier. The charging device is the charging device according to the exemplary embodiment described above.

The process cartridge according to the exemplary embodiment may optionally include at least one device selected from the group consisting of a developing device that develops a latent image formed on a surface of the image carrier with a toner to form a toner image, a transfer device that transfers the toner image formed on the surface of the image carrier to a recording medium, and a cleaning device that removes residual toner from the surface of the image carrier after transfer.

The image forming apparatus and the process cartridge according to the exemplary embodiment may include the assembly according to the exemplary embodiment described above.

Next, the image forming apparatus and the process cartridge according to the exemplary embodiment will be described with reference to FIGS. 4 and 5.

Figure 4:
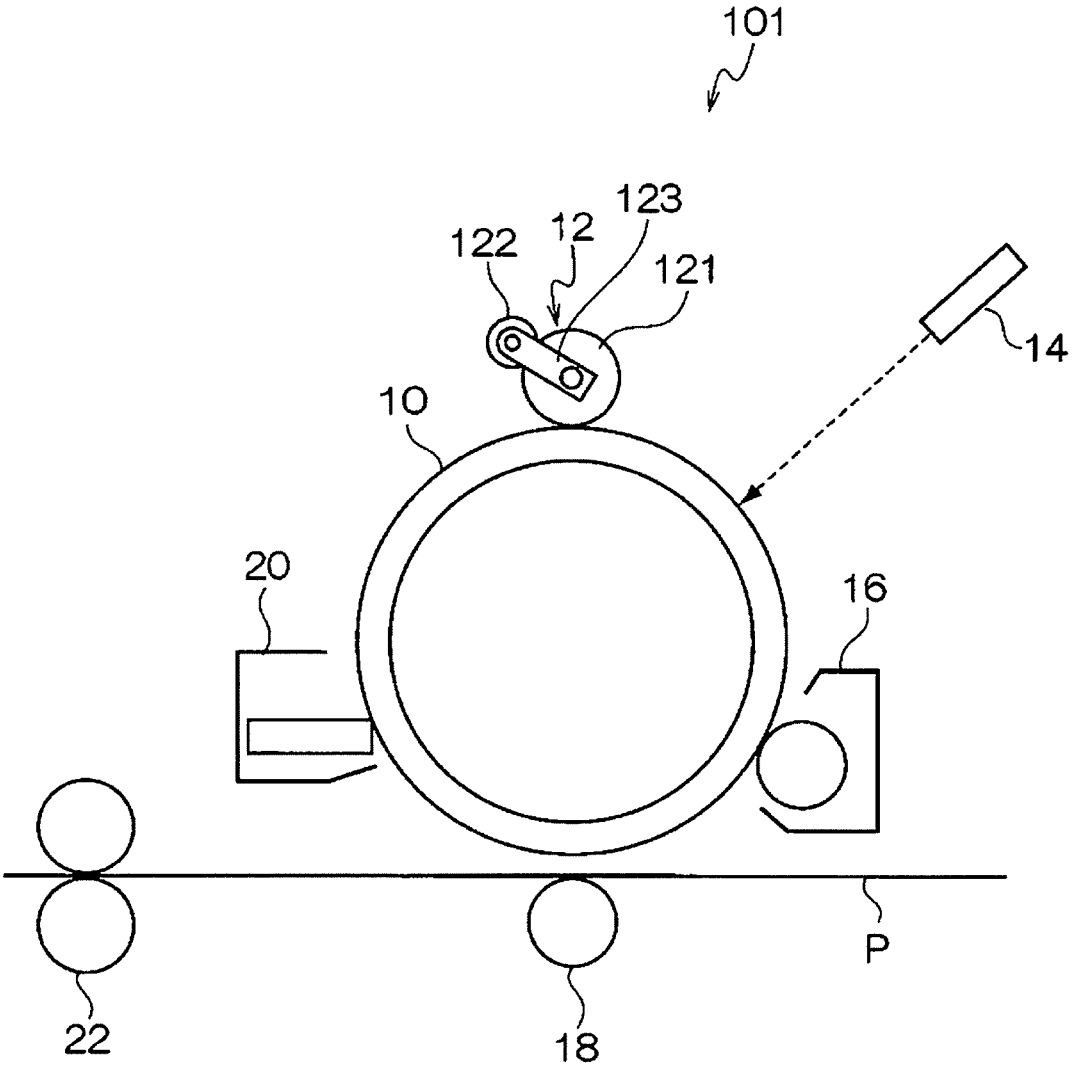
FIG. 4 is a schematic illustration of an image forming apparatus according to the exemplary embodiment.

FIG. 4 is a schematic illustration of the image forming apparatus according to the exemplary embodiment. FIG. 5 is a schematic illustration of the process cartridge according to the exemplary embodiment.

As shown in FIG. 4, an image forming apparatus 101 according to the exemplary embodiment includes an image carrier 10 and, around the image carrier 10, a charging device 12 that charges the image carrier 10, an exposure device (latent image forming device) 14 that exposes the image carrier 10 charged by the charging device 12 to form a latent image, a developing device 16 that develops the latent image formed by the exposure device 14 with a toner to form a toner image, a transfer device 18 that transfers the toner image formed by the developing device 16 to a recording medium P, and a cleaning device 20 that removes residual toner from the surface of the image carrier 10 after transfer. The image forming apparatus 101 according to the exemplary embodiment also includes a fixing device 22 that fixes the toner image transferred to the recording medium P by the transfer device 18.

The image forming apparatus 101 according to the exemplary embodiment includes, as the charging device 12, for example, the charging device according to the exemplary embodiment described above. The charging device according to the exemplary embodiment includes, for example, the charging roller 121, the cleaning roller 122 disposed in contact with the charging roller 121, the conductive bearings 123 (e.g., conductive rolling bearings) supporting the charging roller 121 and the cleaning roller 122 at both ends in the axial direction so that each member is rotatable, and the power supply 124 connected to one of the conductive bearings 123.

As the components other than the charging device 12 (i.e., the charging roller 121 and the cleaning roller 122), components known as components of electrophotographic image forming apparatuses in the related art may be used for the image forming apparatus 101 according to the exemplary embodiment. Examples of the individual components will hereinafter be described.

The image carrier 10 may be any known photoreceptor. For example, the image carrier 10 may be an organic photoreceptor having a so-called separated-function structure in which a photosensitive layer is divided into a charge generation layer and a charge transport layer.

The surface layer of the image carrier 10 may be covered by a protective layer having charge transport properties and having a crosslinked structure. The protective layer may contain a crosslinked component such as a siloxane-based resin, a phenol-based resin, a melamine resin, a guanamine resin, or an acrylic resin.

The layer present in the surface of the image carrier 10 (e.g., the charge transport layer or the surface layer) may contain a silicone oil as a leveling agent.

To reduce the effect of bleed from the charging roller 121, as described above, the silicone oil used may have the same modifying moiety (substituent involved in modification) as the silicone oil present in the foamed elastic layer of the charging roller 121. Specifically, these two silicone oils may be polyester-modified or polyether-modified.

The exposure device 14 may be, for example, a laser optical system or a light-emitting diode (LED) array.

The developing device 16 is, for example, a developing device in which a developer layer is formed on the surface of a developer carrier disposed in contact with or in proximity to the image carrier 10, and the toner is attracted to a latent image on the surface of the image carrier 10 to form a toner image. The developing device 16 may have a known developing system such as one that uses a two-component developer. Examples of developing systems that use two-component developers include cascade systems and magnetic brush systems.

The transfer device 18 may be, for example, a non-contact transfer system such as a corotron or a contact transfer system in which the recording medium P is transported between a conductive transfer roller and the image carrier 10 to transfer a toner image to the recording medium P.

The cleaning device 20 may include, for example, a cleaning blade disposed in direct contact with the surface of the image carrier 10 to remove substances such as toner, paper dust, and debris from the surface of the image carrier 10. Instead of the cleaning blade, the cleaning device 20 may include, for example, a cleaning brush or cleaning roller.

The fixing device 22 may be a heat fixing device that uses a heat roller. The heat fixing device includes, for example, a fixing roller and a pressing roller or pressing belt. The fixing roller includes a cylindrical core having a heater lamp for heating disposed inside the cylindrical core and a heat-resistant resin coating layer or heat-resistant rubber coating layer, serving as a so-called release layer, formed on the outer circumferential surface of the cylindrical core. The pressing roller or pressing belt is disposed in contact with the fixing roller at a specific contact pressure and includes a cylindrical core or belt-shaped substrate having a heat-resistant elastomer layer formed on the outer circumferential surface of the cylindrical core or on the surface of the belt-shaped substrate. An example process of fixing an unfixed toner image includes transporting a recording medium P having an unfixed toner image transferred thereto between the fixing roller and the pressing roller or pressing belt while melting toner components such as a binder resin and additives with heat to fix the toner image.

The image forming apparatus 101 according to the exemplary embodiment is not limited to the foregoing configuration, but may instead be, for example, an intermediate transfer image forming apparatus that uses an intermediate transfer body or a so-called tandem image forming apparatus including a parallel arrangement of image forming units that form toner images of individual colors.

Figure 5:
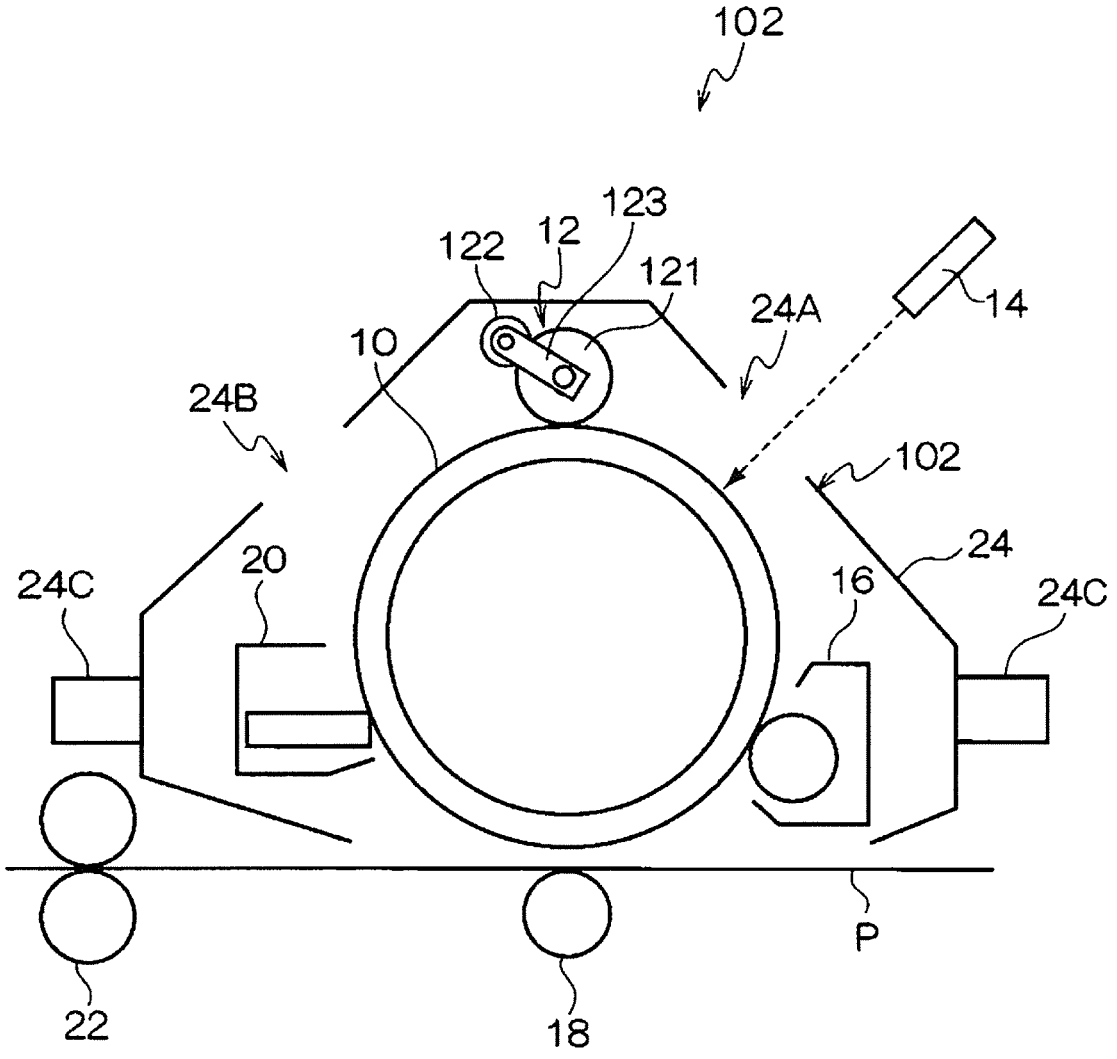
FIG. 5 is a schematic illustration of a process cartridge according to the exemplary embodiment.

As shown in FIG. 5, the process cartridge according to the exemplary embodiment is a process cartridge 102 including a housing 24 having an opening 24A for exposure, an opening 24B for erase exposure, and mounting rails 24C. In the image forming apparatus 101 shown in FIG. 4, the housing 24 holds together the image carrier 10, the charging device 12 that charges the image carrier 10, the developing device 16 that develops a latent image formed by the exposure device 14 with a toner to form a toner image, and the cleaning device 20 that removes residual toner from the surface of the image carrier 10 after transfer. The process cartridge 102 is detachably attached to the image forming apparatus 101 shown in FIG. 4.

Examples

The present disclosure will hereinafter be described in more detail with reference to the following examples, although these examples are not intended to limit the disclosure. Parts are by mass unless otherwise specified.

Fabrication of Charging Rollers

Charging Roller A

Formation of Elastic Layer

The following mixture is kneaded on an open-roll mill and is applied to the outer circumferential surface of a conductive core formed of SUS416 and having a diameter of 8 mm and a length of 378 mm to form a cylindrical coating having a thickness of 2.0 mm. The core is placed in a cylindrical mold having an inner diameter of 12.0 mm, and the coating is vulcanized at 170° C. for 30 minutes. After the core is removed from the mold, the coating is polished. Thus, a cylindrical conductive elastic layer is obtained.

- Rubber material (epichlorohydrin-ethylene oxide-allyl glycidyl ether copolymer rubber, GECHRON 3106 available from Zeon Corporation): 100 parts by mass
- Conductor (carbon black, ASAHI THERMAL available from Asahi Carbon Co., Ltd.): 25 parts by mass
- Conductor (KETJENBLACK EC available from Lion Specialty Chemicals Co., Ltd.): 8 parts by mass
- Ionic conductor (lithium perchlorate): 1 part by mass
- Vulcanizing agent (200 mesh sulfur available from Tsurumi Chemical Industry Co., Ltd.): 1 part by mass
- Vulcanization accelerator (NOCCELER DM available from Ouchi Shinko Chemical Industrial Co., Ltd.): 2.0 parts by mass
- Vulcanization accelerator (NOCCELER TT available from Ouchi Shinko Chemical Industrial Co., Ltd.): 0.5 parts by mass Formation of Surface Layer The following mixture is dispersed in a bead mill. The resulting dispersion is diluted with methanol and is applied to the surface (outer circumferential surface) of the conductive elastic layer by dip coating, following by heat drying at 140° C. for 15 minutes. Thus, Charging Roller A having a surface layer with a thickness of 4 μm is obtained.

- Polymer material (nylon copolymer, AMILAN CM8000 available from Toray Industries, Inc.): 20 parts by mass
- Conductor (antimony-doped tin oxide, SN-100P available from Ishihara Sangyo Kaisha, Ltd.): 30 parts by mass
- Solvent (methanol): 500 parts by mass
- Solvent (butanol): 240 parts by mass Fabrication of Cleaning Rollers Fabrication of Cleaning Roller A A foamed urethane sheet with a thickness of 3.0 mm (EP70S available from Inoac Corporation) is compressed to a thickness of 2.4 mm from above with heated stainless steel and is then cut into a strip with a length of 360 mm and a width of 5 mm. A double-sided tape with a thickness of 0.05 mm (No. 5605 available from Nitto Denko Corporation) is attached over the entire surface of the cut strip to obtain a strip with a double-sided tape.

The resulting strip with the double-sided tape is placed on a horizontal table such that the release paper attached to the double-sided tape faces upward and is wound around a metal core (material=SUM24EZ, outer diameter=5.0 mm, overall length=360 mm) at a helical angle θ of 4515° while being placed under tension so as to increase the overall strip length by 0% to 5%.

By the foregoing process, Cleaning Roller A is obtained.

Fabrication of Cleaning Roller B

The same process as that for Cleaning Roller A is performed except that a foamed urethane sheet with a thickness of 2.4 mm (FHS available from Inoac Corporation) is cut into a strip with a length of 360 mm and a width of 5 mm.

By the foregoing process, Cleaning Roller B is obtained.

Fabrication of Cleaning Roller C

The same process as that for Cleaning Roller A is performed except that a foamed urethane sheet with a thickness of 2.4 mm (EP70S available from Inoac Corporation) is cut into a strip with a length of 360 mm and a width of 5 mm.

By the foregoing process, Cleaning Roller C is obtained.

Fabrication of Cleaning Roller D

The same process as that for Cleaning Roller A is performed except that a foamed urethane sheet with a thickness of 3.0 mm (FHS available from Inoac Corporation) is compressed to a thickness of 2.4 mm from above with heated stainless steel and is then cut into a strip with a length of 360 mm and a width of 5 mm.

By the foregoing process, Cleaning Roller D is obtained.

Fabrication of Cleaning Roller E

The same process as that for Cleaning Roller A is performed except that a foamed urethane sheet with a thickness of 2.8 mm (FHS available from Inoac Corporation) is compressed to a thickness of 2.4 mm from above with heated stainless steel and is then cut into a strip with a length of 360 mm and a width of 5 mm.

By the foregoing process, Cleaning Roller E is obtained.

Examples 1 to 5 and Comparative Examples 1 to 6

Each combination of a charging roller and a cleaning roller shown in Table 1 is incorporated into a charging device of an image forming apparatus (DocuCentre-VI 07771 available from Fuji Xerox Co., Ltd.). The cleaning roller is disposed in contact with the charging roller such that the compression ratio of the foamed elastic layer as represented by Equation (1) is as shown in Table 1.

Thus, a charging device of each example is provided.

Evaluation

Various Properties of Cleaning Rollers

The following various properties of the fabricated cleaning rollers are measured by the methods described above. The results are shown in Table 1.

Number of ends of cell skeleton that protrude from surface of foamed elastic layer Average number of cells in foamed elastic layer Density of foamed elastic layer Area fraction of cell skeleton at depth of 200 μm from surface of foamed elastic layer (referred to as "area fraction of cell skeleton at depth of 200 μm" in the table)

Evaluation for Longitudinal Streak-Like Image Defects Due to Contamination of Charging Roller (Referred to as "Streaks Due to Contamination" in the Table)

The image forming apparatus (DocuCentre-VI 07771 available from Fuji Xerox Co., Ltd.) including the charging device of each example is provided as an apparatus for evaluation, and a halftone image is printed on 100,000 sheets of A4 paper. The image printed on the 100,000th sheet is observed and rated on the following rating scale:

G1: No longitudinal streak-like image defects are found.

G1.5: Some longitudinal streak-like image defects are found, although they are minor image defects with only small differences in density from the background.

G2: Longitudinal streak-like image defects are found in less than 1% of the image area.

G2.5: Longitudinal streak-like image defects are found in 1% or more and less than 2% of the image area.

G3: Longitudinal streak-like image defects are found in 2% or more and less than 5% of the image area.

G4: Longitudinal streak-like image defects are found in 5% or more of the image area.

Evaluation for Lateral Streak-Like Image Defects Due to Compression Set in Cleaning Roller (Referred to as "Streaks Due to Deformation During Storage" in the Table)

The cleaning roller of each example is incorporated into a drum cartridge for an image forming apparatus (DocuCentre-VI C7771 available from Fuji Xerox Co., Ltd.). The drum cartridge is allowed to stand in an environment at 40° C. and 85% RH for one month. Thereafter, the drum cartridge is attached to an image forming apparatus (DocuCentre-VI C7771 available from Fuji Xerox Co., Ltd.), and a halftone image is printed on A4 paper. The printed image is observed and rated on the following rating scale:

G1: No lateral streak-like image defects are found.

G2: Some lateral streak-like image defects are found, although they are minor image defects with only small differences in density from the background.

G3: Lateral streak-like image defects are found in less than 10% of the image width.

G4: Lateral streak-like image defects are found in 10% or more of the image width.

The details of each example are listed in Table 1.

TABLE 1

| | | Cleaning roller | | | | | | | |
|---|---|---|---|---|---|---|---|---|---|
| | Charging roller Type | Type | Number of ends of cell skeleton (ends/mm$^2$) | Average number of cells (cells/25 mm) | Density (kg/m$^3$) | Area fraction of cell skeleton at depth of 200 μm (%) | Compression ratio (%) | Streaks due to contamination | Streaks due to deformation during storage |
| Example 1 | A | A | 25 | 80 | 75 | 45 | 30 | G1.5 | G2 |
| Example 2 | A | B | 31 | 91 | 81 | 55 | 30 | G1 | G2 |
| Example 3 | A | A | 25 | 80 | 75 | 45 | 40 | G2 | G1 |
| Example 4 | A | B | 31 | 91 | 81 | 55 | 10 | G1.5 | G1 |
| Example 5 | A | A | 25 | 80 | 75 | 45 | 8 | G2.5 | G1 |
| Example 6 | A | B | 31 | 91 | 81 | 55 | 8 | G2 | G1 |
| Example 7 | A | D | 49 | 105 | 92 | 62 | 30 | G1 | G3 |
| Example 8 | A | E | 45 | 101 | 89 | 58 | 30 | G1 | G2 |
| Comparative Example 1 | A | C | 12 | 70 | 70 | 33 | 10 | G4 | G1 |
| Comparative Example 2 | A | C | 12 | 70 | 70 | 33 | 40 | G3 | G2 |
| Comparative Example 3 | A | B | 31 | 91 | 81 | 55 | 40 | G1 | G4 |

The above results show that the charging devices of the Examples have a reduced tendency to cause streaks due to contamination (i.e., longitudinal streak-like image defects) and streaks due to deformation during storage (i.e., lateral streak-like image defects) as compared to the charging devices of the Comparative Examples.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A charging device comprising:

a charging roller; and a cleaning roller that includes a core and a foamed elastic layer disposed on an outer circumferential surface of the core and that rotates in contact with a surface of the charging roller, wherein a number of ends of a cell skeleton that protrude from a surface of the foamed elastic layer is 25 ends/mm$^2$ or more and 50 ends/mm$^2$ or less, and wherein the cleaning roller is disposed in contact with the charging roller such that a compression ratio of the foamed elastic layer is 30% or less, the compression ratio being represented by Equation (1):

$$\text{compression ratio } (\%)=(r1/2+r2/2-d)/t1\times 100 \qquad \text{Equation (1):}$$

wherein r1 is an outer diameter (mm) of the cleaning roller, r2 is an outer diameter (mm) of the charging roller, d is an interaxial distance (mm) between the charging roller and the cleaning roller, and t1 is a thickness (mm) of the foamed elastic layer of the cleaning roller.

2. The charging device according to claim 1, wherein the number of ends of the cell skeleton that protrude from the surface of the foamed elastic layer is 30 ends/mm$^2$ or more and 45 ends/mm$^2$ or less.

3. The charging device according to claim 1, wherein the cleaning roller is disposed in contact with the charging roller such that the compression ratio of the foamed elastic layer as represented by Equation (1) is 10% or more and 30% or less.

4. The charging device according to claim 2, wherein the cleaning roller is disposed in contact with the charging roller such that the compression ratio of the foamed elastic layer as represented by Equation (1) is 10% or more and 30% or less.

5. The charging device according to claim 1, wherein an average number of cells in the foamed elastic layer of the cleaning roller is at least 80 cells/25 mm, and a density of the foamed elastic layer of the cleaning roller is 75 kg/m$^3$ or more and 90 kg/m$^3$ or less.

6. The charging device according to claim 2, wherein an average number of cells in the foamed elastic layer of the cleaning roller is at least 80 cells/25 mm, and a density of the foamed elastic layer of the cleaning roller is 75 kg/m$^3$ or more and 90 kg/m$^3$ or less.

7. The charging device according to claim 3, wherein an average number of cells in the foamed elastic layer of the cleaning roller is at least 80 cells/25 mm, and a density of the foamed elastic layer of the cleaning roller is 75 kg/m$^3$ or more and 90 kg/m$^3$ or less.

8. The charging device according to claim 4, wherein an average number of cells in the foamed elastic layer of the cleaning roller is at least 80 cells/25 mm, and a density of the foamed elastic layer of the cleaning roller is 75 kg/m$^3$ or more and 90 kg/m$^3$ or less.

9. The charging device according to claim 5, wherein the average number of cells in the foamed elastic layer of the cleaning roller is at least 90 cells/25 mm, and the density of the foamed elastic layer of the cleaning roller is 80 kg/m$^3$ or more and 90 kg/m$^3$ or less.

10. The charging device according to claim 6, wherein the average number of cells in the foamed elastic layer of the cleaning roller is at least 90 cells/25 mm, and the density of the foamed elastic layer of the cleaning roller is 80 kg/m$^3$ or more and 90 kg/m$^3$ or less.

11. The charging device according to claim 7, wherein the average number of cells in the foamed elastic layer of the cleaning roller is at least 90 cells/25 mm, and the density of the foamed elastic layer of the cleaning roller is 80 kg/m$^3$ or more and 90 kg/m$^3$ or less.

12. The charging device according to claim 1, wherein an area fraction of the cell skeleton at a depth of 200 μm from the surface of the foamed elastic layer of the cleaning roller is 45% or more.

13. The charging device according to claim 2, wherein an area fraction of the cell skeleton at a depth of 200 μm from the surface of the foamed elastic layer of the cleaning roller is 45% or more.

14. The charging device according to claim 3, wherein an area fraction of the cell skeleton at a depth of 200 μm from the surface of the foamed elastic layer of the cleaning roller is 45% or more.

15. The charging device according to claim 12, wherein the area fraction of the cell skeleton at a depth of 200 μm from the surface of the foamed elastic layer of the cleaning roller is 55% or more.

16. The charging device according to claim 13, wherein the area fraction of the cell skeleton at a depth of 200 μm from the surface of the foamed elastic layer of the cleaning roller is 55% or more.

17. The charging device according to claim 14, wherein the area fraction of the cell skeleton at a depth of 200 μm from the surface of the foamed elastic layer of the cleaning roller is 55% or more.

18. A process cartridge attachable to and detachable from an image forming apparatus, the process cartridge comprising:

an image carrier; and the charging device according to claim 1, wherein the charging device charges the image carrier with the charging roller.

19. An image forming apparatus comprising:

an image carrier;

the charging device according to claim 1, wherein the charging device charges the image carrier with the charging roller;

a latent image forming device that forms a latent image on a charged surface of the image carrier;

a developing device that develops the latent image formed on the surface of the image carrier with a toner to form a toner image; and a transfer device that transfers the toner image formed on the surface of the image carrier to a recording medium.

20. An assembly comprising:

a roller to be cleaned; and a cleaning roller that includes a core and a foamed elastic layer disposed on an outer circumferential surface of the core and that rotates in contact with a surface of the roller to be cleaned, wherein a number of ends of a cell skeleton that protrude from a surface of the foamed elastic layer is 25 ends/mm$^2$ or more and 50 ends/mm$^2$ or less, and wherein the cleaning roller is disposed in contact with the roller to be cleaned such that a compression ratio of the foamed elastic layer is 30% or less, the compression ratio being represented by Equation (2):

$$\text{compression ratio } (\%)=(r1/2+r2/2-d)/t1\times 100 \qquad \text{Equation (2):}$$

wherein r1 is an outer diameter (mm) of the cleaning roller, r2 is an outer diameter (mm) of the roller to be cleaned, d is an interaxial distance (mm) between the roller to be cleaned and the cleaning roller, and t1 is a thickness (mm) of the foamed elastic layer of the cleaning roller.

* * * * *